US010400584B2

(12) United States Patent
Palomarez

(10) Patent No.: US 10,400,584 B2
(45) Date of Patent: Sep. 3, 2019

(54) METHODS AND SYSTEMS FOR MONITORING A SUBTERRANEAN FORMATION AND WELLBORE PRODUCTION

(71) Applicant: Baker Hughes, a GE company, LLC, Houston, TX (US)

(72) Inventor: Vincent Palomarez, Cypress, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 424 days.

(21) Appl. No.: 14/826,614

(22) Filed: Aug. 14, 2015

(65) Prior Publication Data

US 2016/0047232 A1 Feb. 18, 2016

Related U.S. Application Data

(60) Provisional application No. 62/038,086, filed on Aug. 15, 2014.

(51) Int. Cl.
*G01V 1/00* (2006.01)
*E21B 47/10* (2012.01)
(Continued)

(52) U.S. Cl.
CPC ..... *E21B 47/1015* (2013.01); *E21B 21/062* (2013.01); *E21B 43/26* (2013.01); *E21B 47/101* (2013.01); *E21B 47/102* (2013.01)

(58) Field of Classification Search
None
See application file for complete search history.

(56) References Cited

U.S. PATENT DOCUMENTS 3,828,867 A * 8/1974 Elwood ..... E21B 7/04 175/45
3,916,821 A * 11/1975 Pies ..... G01C 15/04 116/209

(Continued)

FOREIGN PATENT DOCUMENTS

EP 1225302 A2 * 7/2002 ..... E21B 43/045
WO WO-2007093002 A1 * 8/2007 ..... G01S 15/96

OTHER PUBLICATIONS

Elshahawi, Hani, et al. "Fluid fingerprinting—a real-time analysis tool for deep water." Hart's E & P 84.7 (2011): 50-51. (Year: 2011).*

(Continued)

*Primary Examiner* — Isam A Alsomiri
*Assistant Examiner* — Jonathan D Armstrong
(74) *Attorney, Agent, or Firm* — TraskBritt

(57) ABSTRACT

Methods of monitoring conditions within a wellbore comprise providing a plurality of signal transmitters and a plurality of signal receivers within the wellbore. Marker materials configured with a particular characteristic may interact with signals generated by the plurality of signal transmitters are introduced into the wellbore. The marker materials interact with the signals, forming modified signals. The modified signals are received by the plurality of signal receivers. The plurality of receivers are configured to measure at least one of acoustic activity and an electromagnetic field to determine a location of the marker materials. The electrical conductivity and the magnetism of produced fluids may also be measured to determine a producing zone of the produced fluid. Downhole systems including the marker materials and also disclosed.

20 Claims, 3 Drawing Sheets

(51) Int. Cl.
*E21B 43/26* (2006.01)
*E21B 21/06* (2006.01)

(56) References Cited

U.S. PATENT DOCUMENTS 3,990,512 A * 11/1976 Kuris ..... E21B 43/003 166/249
4,237,972 A * 12/1980 Lanmon, II ..... B23D 15/145 102/313
4,442,152 A * 4/1984 Kirk ..... C09J 7/02 428/195.1
4,456,067 A * 6/1984 Pinner, Jr. ..... C09K 8/92 166/279
4,581,927 A * 4/1986 Johnson ..... E21B 23/10 73/152.36
4,712,094 A * 12/1987 Bolson, Sr. ..... G01C 15/04 324/329
4,741,401 A * 5/1988 Walles ..... C09K 8/685 166/300
4,752,680 A * 6/1988 Larsson ..... G01V 15/00 235/451
4,919,209 A * 4/1990 King ..... C09K 8/64 166/300
5,025,550 A * 6/1991 Zirbes ..... G01V 15/00 29/605
5,151,658 A 9/1992 Muramatsu et al.
5,164,099 A * 11/1992 Gupta ..... C09K 8/62 166/300
5,200,704 A * 4/1993 Clark, Jr. ..... G01B 7/14 116/209
5,426,716 A * 6/1995 Arroyo ..... G01V 15/00 385/100
5,485,148 A * 1/1996 Tseng ..... G01F 1/66 340/10.41
5,532,598 A * 7/1996 Clark, Jr. ..... F16L 1/11 324/326
5,585,725 A * 12/1996 Powell ..... F16L 1/11 252/62.51 R
5,620,049 A * 4/1997 Gipson ..... E21B 43/2401 166/248
5,635,712 A 6/1997 Scott, III et al.
5,699,048 A * 12/1997 Galloway ..... G01V 15/00 340/572.5
5,884,701 A 3/1999 Plahn
6,097,293 A * 8/2000 Galloway ..... F16L 1/11 235/493
6,150,986 A * 11/2000 Sandberg ..... A01K 11/006 340/10.1
6,281,489 B1 8/2001 Tubel et al.
6,333,700 B1 * 12/2001 Thomeer ..... E21B 23/00 166/254.2
6,380,857 B1 * 4/2002 Galloway ..... F16L 1/11 340/572.5
6,789,043 B1 * 9/2004 Nelson ..... G01B 7/004 702/127
7,073,581 B2 7/2006 Nguyen et al.
7,836,952 B2 11/2010 Fripp
8,006,755 B2 8/2011 Bicerano
8,010,048 B2 * 8/2011 Brommer ..... G06K 19/0723 455/343.1
8,260,201 B2 * 9/2012 Rossman ..... G06K 19/07749 340/10.34
8,720,547 B2 5/2014 Banerjee et al.
2002/0121374 A1 9/2002 Ranson et al.
2002/0134587 A1 * 9/2002 Rester ..... E21B 47/10 175/48
2002/0178805 A1 * 12/2002 DiFoggio ..... E21B 33/124 73/152.55
2003/0066645 A1 * 4/2003 Armatage ..... E21B 23/08 166/253.1
2003/0141064 A1 * 7/2003 Roberson, Jr. ..... C09K 8/62 166/300
2004/0069487 A1 4/2004 Cook et al.
2004/0227509 A1 * 11/2004 Ucan ..... B05B 5/1616 324/220
2005/0072570 A1 * 4/2005 Lehman ..... C09K 8/52 166/304
2005/0248460 A1 * 11/2005 Mejia ..... G01V 15/00 340/572.8
2007/0026968 A1 * 2/2007 Ratcliffe ..... A63B 24/0021 473/353
2007/0039739 A1 * 2/2007 Wilson ..... E21B 27/02 166/369
2007/0205902 A1 * 9/2007 Cote ..... E05B 73/0017 340/572.9
2008/0061239 A1 * 3/2008 Bryan ..... G01V 8/12 250/341.1
2008/0069961 A1 * 3/2008 Sarkar ..... C09K 8/524 427/384
2008/0111448 A1 * 5/2008 Smith ..... G10K 11/205 310/311
2008/0156484 A1 * 7/2008 Mese ..... E21B 43/26 166/250.1
2008/0245960 A1 * 10/2008 Csutak ..... E21B 47/10 250/269.1
2008/0308270 A1 * 12/2008 Wilson ..... E21B 43/12 166/244.1
2008/0316049 A1 * 12/2008 Verret ..... E21B 47/10 340/854.6
2009/0032592 A1 * 2/2009 Christensen ..... B01J 19/0046 235/439
2009/0146381 A1 * 6/2009 Herrera ..... E21B 17/1057 277/336
2009/0151939 A1 * 6/2009 Bailey ..... E21B 47/12 166/255.1
2009/0211754 A1 * 8/2009 Verret ..... E21B 47/10 166/250.12
2009/0224919 A1 * 9/2009 Angell ..... B01F 15/00207 340/572.1
2010/0044034 A1 * 2/2010 Bailey ..... E21B 47/1015 166/253.1
2010/0051266 A1 * 3/2010 Roddy ..... E21B 33/13 166/250.01
2010/0181067 A1 * 7/2010 Chen ..... E21B 41/0035 166/253.1
2010/0243241 A1 9/2010 Hampton et al.
2011/0094754 A1 * 4/2011 Smart ..... E21B 27/02 166/381
2011/0108277 A1 5/2011 Dudley et al.
2011/0186290 A1 * 8/2011 Roddy ..... E21B 43/25 166/253.1
2011/0192594 A1 * 8/2011 Roddy ..... E21B 33/13 166/250.01
2011/0215977 A1 * 9/2011 Van Driel ..... A63B 37/0003 343/720
2011/0265314 A1 * 11/2011 Brommer ..... H01Q 1/362 29/600
2011/0269408 A1 * 11/2011 Brommer ..... G06K 1/00 455/67.11
2012/0037368 A1 * 2/2012 Eick ..... C09K 8/516 166/300
2012/0133526 A1 * 5/2012 Christiansen ..... G01V 15/00 340/854.6
2012/0181020 A1 7/2012 Barron et al.
2012/0234537 A1 9/2012 Sultenfuss et al.
2013/0017610 A1 * 1/2013 Roberts ..... C09K 11/06 436/27
2013/0025943 A1 * 1/2013 Kumar ..... E21B 49/084 175/58
2013/0068940 A1 * 3/2013 Jones ..... E21B 47/102 250/253
2013/0075091 A1 * 3/2013 Hallundbæk ..... E21B 47/01 166/250.15
2013/0213638 A1 8/2013 Keller et al.
2013/0300571 A1 * 11/2013 Mohamadi ..... G01V 3/30 340/854.6
2014/0054031 A1 * 2/2014 Heijnen ..... E21B 4/18 166/250.17

(56) References Cited

U.S. PATENT DOCUMENTS

| | | | | |
|---|---|---|---|---|
| 2014/0111349 | A1* | 4/2014 | Roberson | E21B 47/122 340/854.8 |
| 2014/0118156 | A1* | 5/2014 | Christiansen | G01V 15/00 340/854.6 |
| 2014/0174724 | A1* | 6/2014 | Livanec | C09K 8/536 166/247 |
| 2015/0075776 | A1* | 3/2015 | Adams | E21B 43/006 166/246 |
| 2016/0194546 | A1* | 7/2016 | Fuller | C09K 8/516 166/292 |
| 2016/0320769 | A1* | 11/2016 | Deffenbaugh | E21B 47/06 |
| 2017/0101572 | A1* | 4/2017 | Qu | E21B 41/00 |
| 2018/0044570 | A1* | 2/2018 | Fernandez | C09K 8/467 |
| 2018/0258336 | A1* | 9/2018 | Contreras | C04B 24/287 |
| 2018/0258337 | A1* | 9/2018 | Contreras | C04B 28/02 |
| 2018/0362828 | A1* | 12/2018 | Contreras | C09K 8/467 |
| 2019/0062620 | A1* | 2/2019 | Kamdar | C09K 8/706 |
| 2019/0077989 | A1* | 3/2019 | Troxler | B01F 17/0071 |

OTHER PUBLICATIONS

Basu et al., A New Method for Fracture Diagnostics Using Low Frequency Electromagnetic Induction, University of Texas, Fracturing and Sand Control JIP, Annual Meeting, (2014), 54 pages.

International Search Report for International Application No. PCT. US2015/045267 dated Oct. 20, 2015, 3 pages.

International Written Opinion for International Application No. PCT.US2015/045267 dated Oct. 20, 2015, 8 pages.

International Search Report for International Application No. PCT/US2015/041107 dated Apr. 1, 2016, 3 pages.

International Written Opinion for International Application No. PCT/US2015/041107 dated Apr. 1, 2016, 7 pages.

Canadian Office Action for CA Application No. 2957769 dated Dec. 18, 2017, 5 pages.

* cited by examiner

METHODS AND SYSTEMS FOR MONITORING A SUBTERRANEAN FORMATION AND WELLBORE PRODUCTION

CROSS-REFERENCE TO RELATED APPLICATION

This application claims the benefit of the filing date of U.S. Provisional Patent Application Ser. No. 62/038,086, filed Aug. 15, 2014, for "METHODS AND SYSTEMS FOR MONITORING A SUBTERRANEAN FORMATION AND WELLBORE PRODUCTION," the disclosure of which is hereby incorporated herein in its entirety by this reference.

TECHNICAL FIELD

Embodiments of the disclosure relate generally to methods of detecting fluid flow in a subterranean formation. More particularly, embodiments of the disclosure relate to methods of evaluating reservoir production by detecting the location and movement of marker particles within a subterranean formation and a wellbore, and to downhole systems including the marker particles and associated monitoring equipment.

BACKGROUND

Over the production lifetime of a wellbore, the subterranean formation through which the wellbore extends may be stimulated to enhance hydrocarbon recovery from the formation. Methods such as hydraulic fracturing (i.e., "fracking") may enhance hydrocarbon recovery from the subterranean formation. In hydraulic fracturing operations, a hydraulic fracture is formed by injecting a high pressure fluid (e.g., water) including a proppant material (e.g., sand, ceramics, etc.) into a targeted portion of the subterranean formation at conditions sufficient to cause the formation material to fracture. Under the pressures of the hydraulic fracturing process, the proppant is forced into the fractures where the proppant remains, forming open channels through which reservoir fluid (e.g., oil or gas) may pass once the hydraulic fracturing pressure is reduced.

Frequently, radioactive tracers or other tracer materials are injected into the formation at the time of hydraulic fracturing to monitor the effectiveness of the fracturing process, identify patterns of fluid movement within the formation, fracture development, and connectivity within the reservoir. The information obtained may be used by operators to plan and/or modify stimulation treatment and completion plans to further enhance hydrocarbon recovery.

Another method of monitoring the formation, the reservoir, and fluid movement within the subterranean formation includes a technique referred to as "microseismic frac mapping." Microseismic frac mapping includes locating microseismic events associated with fractures to determine the geometry of the fractures and estimate the effective production volume. An array of geophones positioned in an observation well near the completion well or an array of near-surface sensors are used to measure microseismic activity.

However, the use of such radioactive tracers and monitoring techniques is costly, difficult to apply in real time, frequently requires an observation well for the necessary equipment, and may contaminate nearby aquifers.

BRIEF SUMMARY

Embodiments disclosed herein include methods of detecting a location of fluids within a wellbore, as well as related systems for monitoring the conditions within the wellbore. For example, in accordance with one embodiment, a method of detecting a location of fluids within a wellbore comprises providing a plurality of signal transmitters and a plurality of signal receivers in a wellbore at least intersecting a subterranean formation, injecting first marker particles having a first characteristic into a first zone of the subterranean formation and attaching the first marker particles to organic surfaces within the first zone, injecting second marker particles having a second characteristic different than the first characteristic into a second zone of the subterranean formation and attaching the second marker particles to organic surfaces within the second zone, generating a signal with at least one of the plurality of signal transmitters and transmitting the signal through the first marker particles and the second marker particles, and detecting at least one of an acoustic activity and an electromagnetic field with at least one signal receiver of the plurality of signal receivers and detecting a location of at least one of the first marker particles and the second marker particles.

In additional embodiments, a method of detecting the flow of hydrocarbons through fractures in a subterranean formation comprises mixing first marker particles with a fracturing fluid, fracturing a first zone of a subterranean formation with the fracturing fluid and adhering the first marker particles to the subterranean formation within the fractures of the first zone, mixing second marker particles with another fracturing fluid, fracturing a second zone of the subterranean formation with the another fracturing fluid and adhering the second marker particles to the subterranean formation within the fractures of the second zone, and detecting at least one of an electrical conductivity of a produced fluid, a magnetism of the produced fluid, an acoustic activity within at least one of the first zone and second zone, and an electromagnetic field within at least one of the first zone and the second zone.

In further embodiments, a downhole system comprises a wellbore at least intersecting a plurality of zones within a subterranean formation, a plurality of signal transmitters and a plurality of signal receivers extending along the wellbore adjacent the plurality of zones, and first marker particles and second marker particles within the subterranean formation, the first marker particles and the second marker particles configured to be different than the other of the first marker particles and the second marker particles and configured to be at least one of electrically conductive, magnetic, acoustically active, and electromagnetically active.

DETAILED DESCRIPTION

Figure 1:
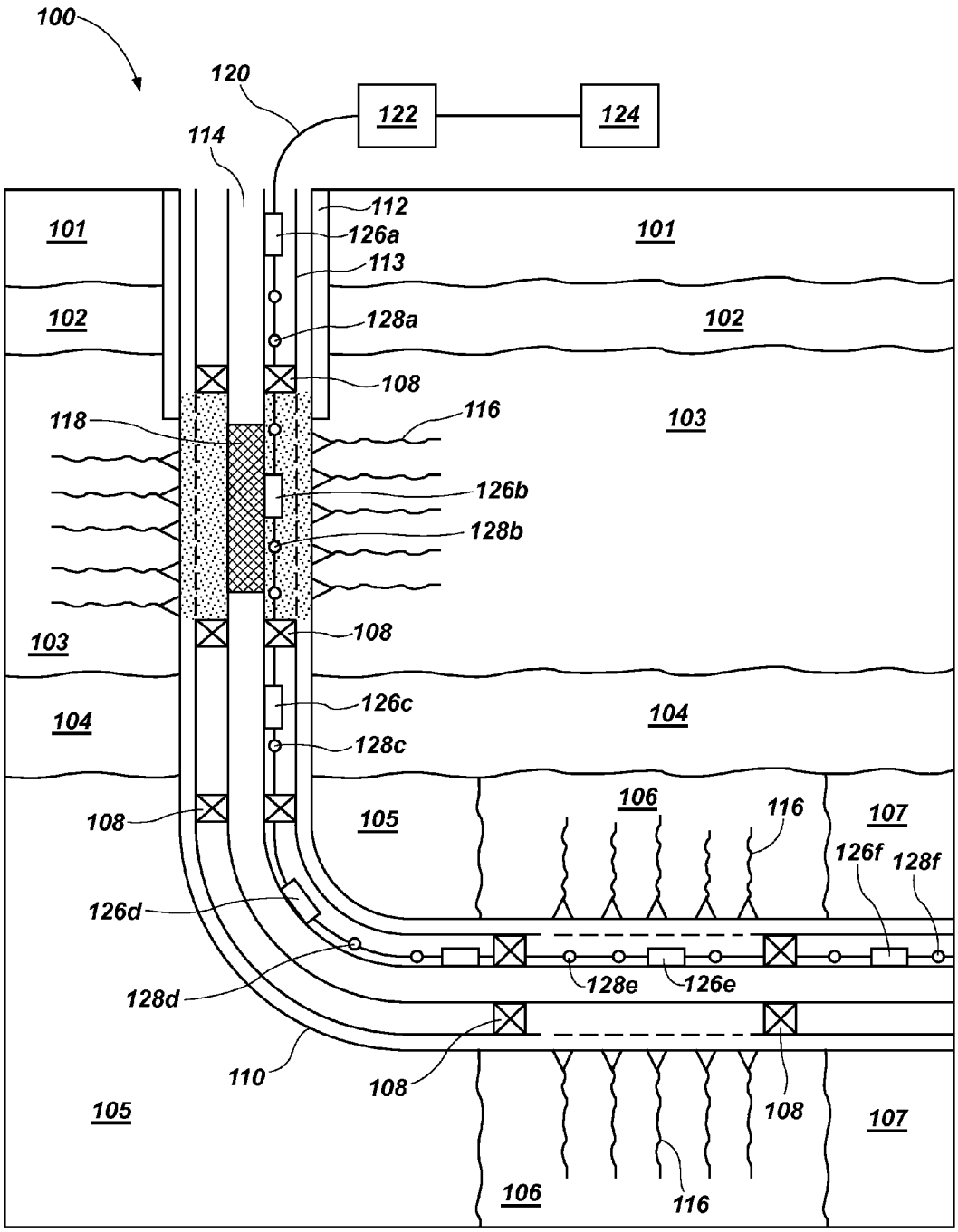
FIG. 1 is a simplified schematic illustrating a system including a wellbore within a subterranean formation, in accordance with embodiments of the disclosure.

Illustrations presented herein are not meant to be actual views of any particular material, component, or system, but are merely idealized representations that are employed to describe embodiments of the disclosure.

The following description provides specific details, such as material types, compositions, material thicknesses, and processing conditions in order to provide a thorough description of embodiments of the disclosure. However, a person of ordinary skill in the art will understand that the embodiments of the disclosure may be practiced without employing these specific details. Indeed, the embodiments of the disclosure may be practiced in conjunction with conventional techniques employed in the industry. In addition, the description provided below does not form a complete process flow for monitoring conditions within a wellbore or a subterranean formation. Only those process acts and structures necessary to understand the embodiments of the disclosure are described in detail below. A person of ordinary skill in the art will understand that some process components (e.g., pipelines, line filters, valves, temperature detectors, flow detectors, pressure detectors, and the like) are inherently disclosed herein and that adding various conventional process components and acts would be in accord with the disclosure. Additional acts or materials to monitor downhole conditions may be performed by conventional techniques.

Operating conditions within a subterranean formation and a wellbore may be determined by injecting marker particles into the subterranean formation and detecting the location and movement of the marker particles within the subterranean formation and the wellbore. Using methods described herein, reservoir properties (e.g., the location of producing zones, stimulated reservoir volumes, etc.) may be determined, as well as the effects of stimulation treatments on production zones immediately after such stimulation treatments. For example, one or more types of marker particles configured to adhere between formation surfaces defining fractures or organic surfaces of the reservoir may be injected into one or more regions of the subterranean formation and the location and movement of the marker particles may be monitored during well operation (e.g., stimulation, completion, production, etc.). Knowledge of the location and movement of the marker particles within the subterranean formation may aid in determining particular zones within the subterranean formation from which produced fluids are recovered, the actual stimulated reservoir volume, and the effectiveness of the stimulation techniques (e.g., hydraulic fracturing). The length and width of conductive fractures formed during the fracturing process may be determined by detecting the location and movement of marker particles in the fractures. Reservoir volume may be determined by detecting the location of marker particles. As the marker particles move within the subterranean formation, the location of producing zones within the subterranean formation may be identified. Responsive to the movement of the marker particles, movement of fluids within the reservoir may be directed to different parts of the reservoir, by adjusting the volume and location of production and/or of the use of stimulation fluids. Accordingly, the real time monitoring of the location and movement of the marker particles within the subterranean formation and wellbore may provide information about the formation geometry, fracture geometry, fracturing effectiveness, reservoir volume, and producing zones.

In some embodiments, a plurality of transmitters within the wellbore is configured to transmit one or more signals within the subterranean formation. The one or more signals may include one or of an acoustic signal and an electromagnetic field. Each of the marker particles may be configured to exhibit one or more characteristics (e.g., an acoustic characteristic, an electrical conductivity characteristic, a magnetic characteristic, an electromagnetic characteristic, etc.) or configured to interact with the one or more signals (e.g., the acoustic signal, the electromagnetic field, etc.). In some embodiments, the marker particles may interact with the one or more signals transmitted by the plurality of transmitters. In other embodiments, the marker particles may be placed within a particular zone of the formation and then subsequently identified in a sample of produced fluid within the wellbore or at the surface, such as by measuring the electrical conductivity or magnetism of the produced fluid.

At least a first portion of the marker particles may exhibit a first characteristic, at least a second portion of the marker particles exhibit a second characteristic, and at least a third portion of the marker particles may exhibit a third characteristic, etc. Each of the portions of the marker particles may be injected into different zones of the subterranean formation. Interaction of the marker particles with the one or more signals transmitted by the plurality of transmitters may create at least one reflected signal that is received by at least one signal receiver of a plurality of signal receivers. The reflected signals may be detected and/or measured by the plurality of signal receivers. The detection of the signals by the plurality of signal receivers may indicate at least one of the location and movement of the marker particles within the subterranean formation. Changes in the signals received by the plurality of receivers may indicate the location and movement of the marker particles within the wellbore and subterranean formation.

In some embodiments, first marker particles are injected into the subterranean formation at a first zone. Second marker particles may be injected into the subterranean formation at a second zone. The first marker particles and the second marker particles may exhibit different characteristics (e.g., an acoustic characteristic, an electrical conductivity characteristic, a magnetic characteristic, an electromagnetic characteristic, etc.) than each other. If the first marker particles travel into the second zone, receivers of the plurality of receivers located within the second zone may identify such movement by a change in the signals (e.g., acoustic activity, electromagnetic field, etc.) received by the receivers. The receivers in the first zone may also detect changing signals as the first marker particles move away from the first zone. If hydrocarbons from within the first zone are produced, a receiver in the wellbore or at the surface may identify the first marker particles within the produced fluid (e.g., by detecting an electrical conductance, a magnetism, etc., of the produced fluid).

During completion of a well, hydrocarbon recovery may be enhanced by creating fractures in a subterranean formation containing hydrocarbons. Hydraulic or propellant-based fracturing may create fractures in the subterranean formation in zones adjacent hydrocarbon-containing regions to create channels through which reservoir fluids may flow to the wellbore, through a production string, and to the surface. An hydraulic fracturing process may include injecting a fracturing fluid (e.g., water, a high velocity propellant gas, etc.) into a wellbore at high pressures. The fracturing fluid may be directed at a face of a hydrocarbon bearing subterranean formation. The high pressure fracturing fluid creates fractures in the subterranean formation. Proppant mixed into fracturing fluids may be introduced (e.g., injected) into the formation to prop open the fluid channels created during the fracturing process at pressures below the pressure at which the fractures are created. The fractures, when open, may provide a flow path for reservoir fluids (e.g., hydrocarbon-containing fluids) within the formation to flow from the formation to the production string and to the surface. In some embodiments, the marker particles include proppant particles mixed into and delivered to the subterranean formation through the fracturing fluid. The marker particles may be coated onto surfaces of proppant materials (e.g., sand, ceramics, particulates, etc.). In embodiments employing propellant-based fracturing, proppant particles and marker particles (or proppant particles configured as marker particles) may be preplaced in wellbore fluid adjacent a propellant-based stimulation tool, and driven into fractures created in the producing formation by high pressure gas generated by combustion of the propellant.

Fracturing fluids may include water, water and potassium chloride solutions, carbonates such as sodium carbonate and potassium carbonate, gelled fluids, foamed gels, cross-linked gels, acids, ethylene glycol, and combinations thereof. Non-limiting examples of the fracturing fluid include gelled fluids such as materials including guar gum (e.g., hydroxypropylguar (HPG), carboxymethylhydroxypropylguar (CMHPG), hydroxyethyl cellulose (HEC) fluids), gels such as borate cross-linked fluids and borate salts, hydrochloric acid, formic acid, acetic acid, and combinations thereof.

In embodiments where the marker particles include proppants, the marker particles include materials such as sand, ceramics, or other particulate materials. The marker particles, when placed within the fractures, may prevent the fractures from closing, increasing the permeability of the formation and enhancing hydrocarbon recovery through the fractures. However, during production, the marker particles may be removed from surfaces of the formation, and fractures previously held open by the marker particles may close, restricting the flow of reservoir fluids out of the reservoir and into the production string. For example, the marker particles may mechanically fail (e.g., such as by being crushed) under closure stresses exerted by the formation after the fracturing pressure is withdrawn. Mechanical failure of the marker particles may generate very fine particulates (e.g., "fines"), which may damage wellbore equipment, clog the wellbore, and reduce overall production. During production stages (e.g., after the pressure of the hydraulic fracturing process is reduced), the marker particles may detach from surfaces of the subterranean formation, from the fractures, from frac pack assemblies, and sidewalls of the wellbore and production tubing. The forces exerted by a produced fluid as the produced fluid travels by the marker particles attached within the wellbore may detach the marker particles from surfaces to which they are adhered. After detaching from such surfaces, the marker particles may be transported with the produced fluid flowing to the surface. However, flow back of the marker particles may reduce the production rates by closing the fractures between the reservoir and the production string and by clogging the wellbore and wellbore equipment. A change in production rates may be attributed to failure of the marker particles or movement of the marker particles from the fractures. In response to failure or movement of the marker particles within fractures, specific zones within the subterranean formation may be targeted for additional stimulation to restore production rates.

The marker particles may be configured to adhere to surfaces of the subterranean formation, a frac pack assembly within the wellbore, sidewalls of the production tubing, and sidewalls of the wellbore. At least some of the marker particles may be configured to adhere to carbon-based materials, such as specific carbonate molecules (e.g., limestone) within the subterranean formation. The marker particles may be configured to adhere to organic surfaces within the subterranean formation. In some embodiments, a mixture including the marker particles is flowed through the subterranean formation and marker particles adhere to hydrocarbon bearing surfaces of the subterranean formation. The location of the adhered marker particles may aid in estimating a volume of hydrocarbons that may be produced from the formation.

The marker particles may include proppants, nanoparticles, and combinations thereof. As used herein, the term "nanoparticles" means and includes particles having an average particle size of less than about 1,000 nm. The marker particles may be introduced into the subterranean formation with fracturing fluids, with stimulation chemicals via chemical injection pumps, and combinations thereof. In some embodiments, marker particles including proppants, nanoparticle markers, proppants coated with nanoparticle markers, and combinations thereof are introduced into the subterranean formation with fracturing fluids at the time of fracturing.

The marker particles may have biomarkers configured to attach to organic surfaces of the formation. For example, the marker particles may be configured to attach to hydrocarbon-containing surfaces of the subterranean formation. The marker particles may adhere to walls of the hydrocarbon-containing formation and the location of the marker materials may aid in determining the volume of the stimulated reservoir. In some embodiments, the movement or presence of specific materials within the subterranean formation may be detected with the marker particles. The marker particles may include molecules or functional groups configured to adhere to at least one of asphaltenes, alkanes, clays, and biological incrustation. Detection of marker particles configured to attach to a particular material (e.g., asphaltenes, alkanes, clays, biological incrustation) may be an indication of the location or movement of the particular material to which the marker particles are configured to attach.

At least a portion of the marker particles injected into the subterranean formation and the location of the marker particles may be detected to identify movement of the marker particles within the subterranean formation. Referring to FIG. 1, a wellbore system 100 within a subterranean formation is shown. The subterranean formation may include a plurality of zones, including a first zone 101 proximate a surface of the earth, an aquifer zone 102 between the first zone 101 and a hydrocarbon-containing zone 103, a non-hydrocarbon-containing zone 104, a first horizontal zone 105, a second horizontal zone 106, and a third horizontal zone 107. A wellbore 110 may extend through the subterranean formation and through each of the first zone 101, the aquifer zone 102, the hydrocarbon-containing zone 103, the non-hydrocarbon-containing zone 104, the first horizontal zone 105, the second horizontal zone 106, and the third horizontal zone 107. Cement 112 may line the wellbore 110 at least through the first zone 101, the aquifer zone 102, and a portion of the hydrocarbon-containing zone 103. A liner string 113 may line at least a portion of the wellbore 110. A production string 114 may extend through the subterranean formation and to a portion of the formation bearing hydrocarbons to be produced.

Individual sections of the production string 114 may be isolated from other sections of the production string 114 by one or more packers 108. The packers 108 may include production packers, swellable packers, mechanical set packers, tension set packers, rotation set packers, hydraulic set packers, inflatable packers, or combinations thereof. The hydrocarbon-containing zone 103 may be isolated from each of the aquifer zone 102 and the non-hydrocarbon-containing zone 104 by packers 108. The second horizontal zone 106 may be isolated from each of the first horizontal zone 105 and the third horizontal zone 107 by packers 108.

The hydrocarbon-containing zone 103 may include a fracturing and gravel pack assembly 118 (e.g., a frac pack assembly). Gravel within the frac pack assembly 118 may filter sand and fines from the formation as produced fluids flow through the frac pack assembly 118 and into the production string 114. In some embodiments, at least a portion of the marker particles may become entrained in the produced fluid may also become trapped within the frac pack assembly 118, such as when the marker particles acting as proppants mechanically fail. Detection of the marker particles within the frac pack assembly 118 may indicate failure of the proppant marker particles. In some embodiments, a portion of marker particles (e.g., nanoparticles) that are smaller than proppant marker particles may pass through the frac pack assembly 118 while proppant marker particles are trapped within the frac pack assembly 118.

With continued reference to FIG. 1, the production string 114 may include a communication device 120 extending from the surface of the formation along the production string 114 providing a means for communicating information to and from the surface of the formation. In some embodiments, the communication device 120 extends along an outer surface of the production string 114. The communication device 120 may include a fiber optic cable. In other embodiments, the communication device 120 includes a wired communication device, a radio communication device, an electromagnetic communication device, or a combination of such devices.

The communication device 120 may be installed at the time of placing the production string 114 within the wellbore 110 using methods and communication devices 120 as disclosed in, for example, U.S. Pat. No. 6,281,489 B1 to Tubel et al., which issued Aug. 28, 2001, the disclosure of which is hereby incorporated herein in its entirety by this reference. Although FIG. 1 depicts the communication device 120 extending along an outer surface of the production string 114, the communication device 120 may be attached to an inner surface of the production string 114, to the liner string 113, and to combinations thereof. The communication device 120 may be installed at the same time that the production string 114 or the liner string 113 are installed in the wellbore 110.

The communication device 120 may be coupled to a source 122, which may include a power source, a light source (e.g., for a fiber optics communications means 120), etc. Data from the communication device 120 may be sent to a data acquisition and processing unit 124.

A plurality of signal transmitters and a plurality of signal receivers may be provided and in communication with the communication device 120. The communication device 120 may be attached to a plurality of transmitters 126*a*, 126*b*, 126*c*, 126*d*, 126*e*, 126*f* and a plurality of receivers 128*a*, 128*b*, 128*c*, 128*d*, 128*e*, 128*f*. Each of the plurality of transmitters 126*a*, 126*b*, 126*c*, 126*d*, 126*e*, 126*f* and each of the plurality of receivers 128*a*, 128*b*, 128*c*, 128*d*, 128*e*, 128*f* may be permanently installed within the wellbore 110. Each of the plurality of receivers 128*a*, 128*b*, 128*c*, 128*d*, 128*e*, 128*f* may transmit data (e.g., signals received or detected) about conditions within the wellbore 110 to the data acquisition and processing unit 124 in real time. The transmitters 126*a*, 126*b*, 126*c*, 126*d*, 126*e*, 126*f* and receivers 128*a*, 128*b*, 128*c*, 128*d*, 128*e*, 128*f* may be intermittently spaced within the wellbore 110, such as at particular locations of interest within the wellbore 110, or may be formed uniformly along the production string 114, the liner string 113, and combinations thereof.

Each of the plurality of transmitters 126*a*, 126*b*, 126*c*, 126*d*, 126*e*, 126*f* may be configured to generate and propagate at least one signal into the subterranean formation and wellbore 110. As used herein, the term "signal" means and includes a wave (e.g., an acoustic wave, electromagnetic energy, electromagnetic radiation, etc.), a field (e.g., an acoustic field, an electromagnetic field, etc.), a pulse (e.g., an acoustic pulse, an electromagnetic pulse (e.g., a short burst of electromagnetic energy), etc.). Thus, the terms, "signal," "wave," "field," and "pulse," may be used interchangeably herein.

By way of non-limiting example, each of the plurality of transmitters 126*a*, 126*b*, 126*c*, 126*d*, 126*e*, 126*f* may be configured to generate at least one of an acoustic signal and an electromagnetic signal. In some embodiments, the plurality of transmitters 126*a*, 126*b*, 126*c*, 126*d*, 126*e*, 126*f* is configured to transmit at least one of an acoustic field, and an electromagnetic field, and may also be configured to generate at least another of an acoustic field, and an electromagnetic field. In some embodiments, at least some of the plurality of transmitters 126*a*, 126*b*, 126*c*, 126*d*, 126*e*, and 126*f* is configured such that an electric current flows from at least some of the plurality of transmitters 126*a*, 126*b*, 126*c*, 126*d*, 126*e*, and 126*f* to at least some other transmitters of the plurality of transmitters 126*a*, 126*b*, 126*c*, 126*d*, 126*e*, and 126*f*.

Each of the plurality of receivers 128*a*, 128*b*, 128*c*, 128*d*, 128*e*, 128*f* may be configured to receive and measure (e.g., detect) at least one type of signal of the signals generated and propagated by the plurality of transmitters 126*a*, 126*b*, 126*c*, 126*d*, 126*e*, 126*f*. As the generated signals propagate through the subterranean formation, fractures 116, reservoir fluids, etc., a portion of the signals may be reflected, absorbed, or otherwise affected. Each of the plurality of receivers 128*a*, 128*b*, 128*c*, 128*d*, 128*e*, 128*f* may be configured to measure at least one reflected signal. Accordingly, each of the plurality of receivers 128*a*, 128*b*, 128*c*, 128*d*, 128*e*, 128*f* may be configured to detect at least one of a reflected acoustic signal (e.g., a sound velocity, amplitude, frequency, etc.), and a reflected electromagnetic signal (e.g., an electromagnetic field). Each of the plurality of receivers 128*a*, 128*b*, 128*c*, 128*d*, 128*e*, 128*f* may detect the at least one reflected signal. In some embodiments, each of the plurality of receivers 128*a*, 128*b*, 128*c*, 128*d*, 128*e*, 128*f* may detect an acoustic characteristic, an electromagnetic field, and/or combinations thereof. The detected signals may be communicated through the communication device 120 to the data acquisition and processing unit 124.

Each of the receivers 128*a*, 128*b*, 128*c*, 128*d*, 128*e*, 128*f* may be configured to measure several other conditions, such as temperature, pressure, flow rate, sand detection, phase measurement, oil-water content (e.g., water-cut), density, and/or seismic measurement, and to communicate such information to the data acquisition and processing unit 124 through the communication device 120.

The signals detected by the receivers 128*a*, 128*b*, 128*c*, 128*d*, 128*e*, 128*f* over a period of time and may indicate the distance and volume through which the marker particles have traveled. The signals detected by the plurality of receivers 128*a*, 128*b*, 128*c*, 128*d*, 128*e*, 128*f* may be recorded and logged over a period of time. In some embodiments, the signals are continuously logged in real time.

Each section of the wellbore 110 within particular locations of the subterranean formation may include at least one transmitter of the plurality of transmitters 126*a*, 126*b*, 126*c*, 126*d*, 126*e*, 126*f* and at least one receiver of the plurality of receivers 128*a*, 128*b*, 128*c*, 128*d*, 128*e*, 128*f*. In some embodiments, a first plurality of signal transmitters and a first plurality of signal receivers are provided in a first zone of the subterranean formation and a second plurality of signal transmitters and a second plurality of signal receivers are provided in a second zone of the subterranean formation. For example, at least one transmitter 126*a* and at least one receiver 128*a* may be located above the frac pack assembly 118 of the hydrocarbon-containing zone 103 (e.g., in the aquifer zone 102). The hydrocarbon-containing zone 103 may include at least one transmitter 126*b* and at least one receiver 128*b*. In some embodiments, the hydrocarbon-containing zone 103 includes a transmitter 126*b* and a receiver 128*b* within the frac pack assembly 118 and at least another transmitter 126*b* and another receiver 128*b* outside the production string 114. At least one transmitter 126*c* and at least one receiver 128*c* may be located below the hydrocarbon-containing zone 103, such as in the non-hydrocarbon-containing zone 104.

Various horizontal portions of the wellbore 110 may each include at least one transmitter and at least one receiver. The first horizontal zone 105 may include at least one transmitter 126*d* and at least one receiver 128*d*. The second horizontal zone 106, may include at least one transmitter 126*e* and at least one receiver 128*e*. The third horizontal zone 107 may include at least one transmitter 126*f* and at least one receiver 128*f*. Thus, an acoustic signal an electromagnetic field, and combinations thereof may be measured in each zone (e.g., the first zone 101 and aquifer zone 102, the hydrocarbon-containing zone 103, the non-hydrocarbon-containing zone 104, the first horizontal zone 105, the second horizontal zone 106, and the third horizontal zone 107) within the subterranean formation.

The marker particles may be configured to be substantially electrically conductive or substantially electrically non-conductive (i.e., resistive), substantially magnetic or substantially non-magnetic, substantially electromagnetically active or substantially non-electromagnetically active, substantially acoustically conductive or substantially acoustically non-conductive, and combinations thereof. As used herein, an "acoustically active" material means and includes a material that transmits sound, such as by reflecting acoustic waves without substantially altering the properties (e.g., frequency, amplitude, velocity, etc.) of the acoustic waves of an acoustic field. As used herein, an "acoustically non-active" material means and includes a material that substantially absorbs (e.g., does not reflect) or otherwise interact with acoustic waves of an acoustic field and alter at least one property (e.g., frequency, amplitude, velocity, etc.) of the acoustic waves of the acoustic field. As used herein, the term "electromagnetically non-active" means and includes a material that substantially alters an electromagnetic field. As used herein, the term "electromagnetically active" means and includes a material that does not substantially alter an electromagnetic field and does not substantially interact with an electromagnetic field.

The marker particles may be configured to interact (e.g., absorb, reflect, amplify, dampen, modify, etc.) with signals generated by the plurality of transmitters 126*a*, 126*b*, 126*c*, 126*d*, 126*e*, 126*f*. The movement of fluids within the wellbore system 100 may be detected by tracking the location of the marker particles over a period of time. Signals generated by the plurality of transmitters 126*a*, 126*b*, 126*c*, 126*d*, 126*e*, 126*f* may interact with the subterranean formation and the marker particles within the subterranean formation to form the signals detected by the plurality of receivers 128*a*, 128*b*, 128*c*, 128*d*, 128*e*, 128*f*. Interaction of the marker particles with the signals generated by the plurality of transmitters 126*a*, 126*b*, 126*c*, 126*d*, 126*e*, 126*f* may create a unique signal detected by each of the plurality of receivers 128*a*, 128*b*, 128*c*, 128*d*, 128*e*, 128*f* Thus, the plurality of transmitters 126*a*, 126*b*, 126*c*, 126*d*, 126*e*, 126*f* may generate a signal and the signal may be affected by the marker particles within the formation. Locations of the marker particles may be detected by receiving a signal reflected from the marker particles with at least one of the plurality of receivers 128*a*, 128*b*, 128*c*, 128*d*, 128*e*, 128*f* Movement of the marker particles may be determined by logging the locations of the marker particles over a period of time. For example, data about the signals received by the plurality of receivers 128*a*, 128*b*, 128*c*, 128*d*, 128*e*, 128*f* may be processed in the data acquisition and processing unit 124 in real time to determine the movement of the proppants within the subterranean formation and within the wellbore 110. In some embodiments, at least one of the acoustic field and the electromagnetic field within the subterranean formation is measured prior to injecting the marker particles into the subterranean formation. The received signals may correspond to a particular location of particular marker materials, such as a distance of each marker particle from the each of the plurality of receivers 128*a*, 128*b*, 128*c*, 128*d*, 128*e*, and 128*f* detecting the signal. As the location of individual marker particles or groups of marker particles within the subterranean formation is determined, an actual reservoir volume and an actual stimulated volume may be estimated to estimate the effectiveness of stimulation techniques.

At least a portion of the marker particles may be configured to have a distinct electric characteristic (e.g., electrical conductivity or electric resistivity), a distinct magnetic characteristic (e.g., magnetism), a distinct electromagnetic characteristic (e.g., electromagnetically active or electromagnetically non-active), and a distinct acoustic characteristic (e.g., acoustically active or acoustically non-active). For example, a first portion of the marker particles may be coated with a material exhibiting a first acoustic activity, a first electric conductivity, a first magnetism, or a first electromagnetic characteristic. A second portion of the marker particles may be coated with another material exhibiting a second acoustic activity, a second electric conductivity, a second magnetism, or a second electromagnetic characteristic. A third portion of the marker particles may not be coated and may exhibit a third acoustic activity, a third electric conductivity, a third magnetism, or a third electromagnetic characteristic.

The produced fluid may be analyzed at the surface for the presence of at least some of the marker particles. For example, an electrical conductivity of the produced fluid, a magnetism of the produced fluid, and combinations thereof may be measured at the surface. A produced fluid with a distinct electrical conductivity may be an indication that the produced fluids are produced from a particular zone in which marker particles with the distinct electrical conductivity were introduced.

Figure 2A:
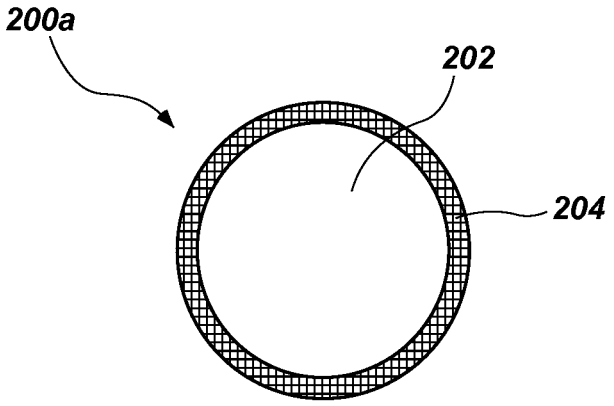
FIG. 2A through FIG. 2D are simplified schematics of marker particles in accordance with embodiments of the disclosure.
Figure 2B:
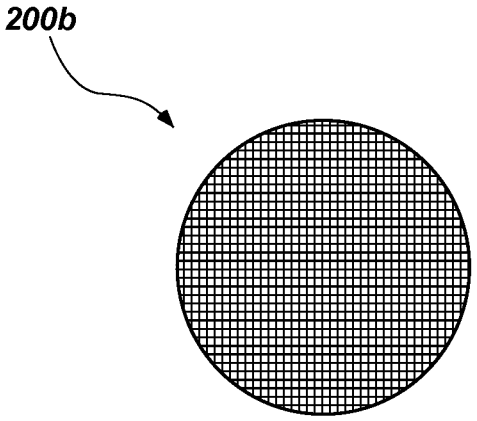

Referring to FIG. 2A, a hollow marker particle 200*a* including a hollow central portion 202 defined by a solid outer shell 204 is shown. The hollow marker particle 200*a* may be configured to be substantially acoustically non-active. Referring to FIG. 2B, a solid marker particle 200*b* is shown. The solid marker particle 200*b* may exhibit different acoustic characteristics than the hollow marker particle 200*a*. The solid marker particle 200*b* may be configured be acoustically active. In some embodiments, the solid marker particle 200*b* may be configured to reflect a greater percentage of acoustic waves back to the plurality of receivers 128*a*, 128*b*, 128*c*, 128*d*, 128*e*, 128*f* than the hollow marker particle 200*a*. In some embodiments, hollow marker particles 200*a* are mixed with a fracturing fluid and pumped into the wellbore 110 and solid marker particles 200*b* are mixed with another fracturing fluid and pumped into the wellbore 110. The hollow marker particles 200*a* and the solid marker particles 200*b* may be pumped into the same or different portions of the wellbore 110.

Figure 2C:
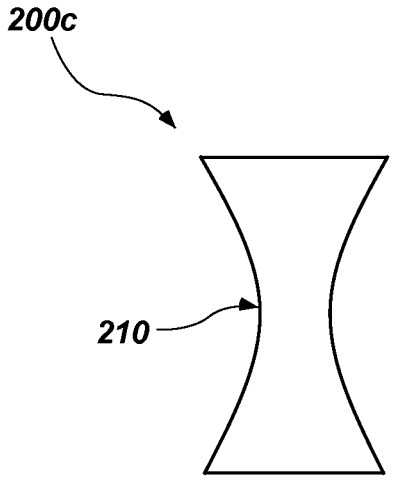
Figure 2D:
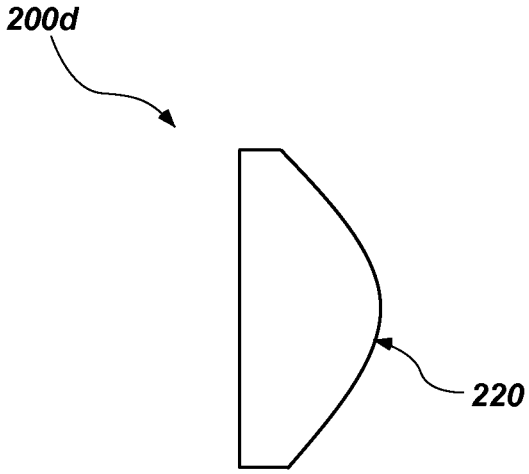

In some embodiments, first marker particles having a first shape may be injected into a first zone of the subterranean formation and second marker particles having a second shape may be injected into a second zone of the subterranean formation. Referring to FIG. 2C, concave marker particles 200*c* may include particles having at least one inwardly curved (e.g., rounded) surface 210. Referring to FIG. 2D, convex marker particles 200*d* may include particles having at least one outwardly curved (e.g., rounded) surface 220. In some embodiments, concave marker particles 200*c* may be injected into the first zone and convex marker particles 200*d* may be injected into the second zone. The concave marker particles 200*c* may reflect more or less acoustic waves than the convex marker particles 200*d*. For example, concave marker particles 200*c* may be configured to absorb more acoustic waves than convex marker particles 200*d*. In some embodiments, at least some of the marker particles are convex and at least some of the proppant particles are concave.

The marker particles may be surrounded by an encapsulant. The encapsulant may be configured to release the marker particles at one of a predetermined exposure time within the subterranean formation, a predetermined temperature, a predetermined pressure, or a predetermined salinity. Encapsulated marker particles configured to release marker particles at a temperature, a pressure, or a salinity of a first zone may be introduced into the formation and other encapsulated marker particles configured to release other marker particles at a temperature, a pressure, or a salinity of a second zone may be introduced into the second zone. By way of non-limiting example, a first portion of marker particles may be configured to be released at a first temperature, a second portion of marker particles may be configured to be released at a second temperature, and a third portion of marker particles may be configured to be released at a third temperature, etc. As another example, movement of marker particles and fluids through a high salinity zone may be monitored by introducing marker particles configured to be released at high salinity conditions (e.g., corresponding to the salinity of a targeted zone) and monitoring movement of the marker particles. As another example, movement of marker particles at different locations (e.g., that may correspond to different temperatures, pressures, or salinities within the subterranean formation) may be monitored by introducing marker particles configured to be released at the temperatures, pressures, or salinities that correspond to the particular locations (e.g., depths) within the subterranean formation and monitoring movement of the marker particles.

In some embodiments, first marker particles may be placed within and adhere to a first portion of the subterranean formation, second marker particles may be placed within and adhere to a second portion of the subterranean formation, and third marker particles may be placed within and adhere to a third portion of the subterranean formation. For example, referring to FIG. 1, the first marker particles may be injected into the subterranean formation at the second horizontal zone 106. The second marker particles may be injected into the subterranean formation within the hydrocarbon-containing zone 103 and may be configured to adhere to the subterranean formation within the fractures 116. The third marker particles may be injected into the wellbore 110 and may be configured to attach to sand or gravel particles of the frac pack assembly 118 and on portions of the liner string 113 or production string 114 adjacent the frac pack assembly 118. Each of the first marker particles, the second marker particles, and the third marker particles may interact differently with the signals generated by the plurality of transmitters 126*a*, 126*b*, 126*c*, 126*d*, 126*e*, 126*f* than each of the other of the first marker particles, the second marker particles, and the third marker particles. Thus, a reflected signal from each of the first marker particles, the second marker particles, and the third marker particles may exhibit a characteristic signal based on each of the marker particles. For example, the first marker particles may exhibit a first acoustic activity, the second marker particles may exhibit a second acoustic activity, and the third marker particles may exhibit a third acoustic activity and each of the plurality of receivers 128*a*, 128*b*, 128*c*, 128*d*, 128*e*, 128*f* may measure a distinct acoustic signal based on the location of the first marker particles, the second marker particles, and the third marker particles. In other embodiments, first marker particles may be electrically conductive and second marker particles may be electrically resistive. In other embodiments, producing zones may be identified by measuring the electrical conductivity of the produced fluid at the surface and correlating the electrical conductivity to marker particles injected into particular producing zones.

At least a portion of the marker particles may be configured to have a characteristic electrical conductivity, a characteristic magnetism, or configured to interact with at least one of an acoustic signal, and an electromagnetic field generated by the plurality of transmitters 126*a*, 126*b*, 126*c*, 126*d*, 126*e*, 126*f* and at least another portion of the marker particles may be configured to have a characteristic electrical conductivity, a characteristic magnetism, or configured to interact with another of the acoustic signal, and the electromagnetic field generated by the plurality of transmitters 126*a*, 126*b*, 126*c*, 126*d*, 126*e*, 126*f*. In some embodiments, a first portion of marker particles configured to be acoustically active may be introduced into a first zone of the subterranean formation and a second portion of marker particles configured to have a characteristic electrical conductivity, a characteristic magnetism, or configured to interact with an electromagnetic field may be introduced into a second zone of the subterranean formation. In other embodiments, a first portion of marker particles is pumped into a first zone of the subterranean formation, a second portion of marker particles is pumped into a second zone of the subterranean formation, and a third portion of marker particles is pumped into a third zone of the subterranean formation. Each of the first portion of marker particles, the second portion of marker particles, and the third portion of marker particles may be configured to interact with different types of signals and/or exhibit different characteristics than the other of the first portion of marker particles, the second portion of marker particles, and the third portion of marker particles. Although the above examples have been described with two or three different marker particles, any number of portions of market materials with different characteristics and interactions with signals generated by the plurality of transmitters 126*a*, 126*b*, 126*c*, 126*d*, 126*e*, 126*f* may be used.

The location of particular marker particles may be detected to determine operating parameters within the wellbore 110. Each receiver of the plurality of receivers 128*a*, 128*b*, 128*c*, 128*d*, 128*e*, 128*f* may be configured to receive information about the marker particles within the wellbore 110, the fractures 116, and the subterranean formation. The signals detected by each receiver may indicate the location of marker particles in the wellbore system 100. Changes in the signals received by the plurality of receivers 128*a*, 128*b*, 128*c*, 128*d*, 128*e*, 128*f* may indicate movement of fluids and marker particles within the wellbore system 100. For example, a first marker particle that is injected into the subterranean formation at a first zone of the subterranean formation may exhibit different characteristics than a second marker particle injected into an adjacent zone. If the first marker particle travels into the adjacent zone of the subterranean formation, the receivers in the adjacent zone may identify such movement by a change in the signals (e.g., the acoustic activity, the electromagnetic field, etc.) received by the receivers in the second zone. The receivers in the first zone may also detect changing signals as the first marker particles move away from the first zone. In some embodiments, the first marker particles include hollow proppants. A receiver in the adjacent zone where the first marker particles are introduced may receive a different acoustic signal (e.g., a weaker acoustic signal) when the first marker particles move into the adjacent zone.

Thus, changes in acoustic activity or in an electromagnetic field measured by the receivers 128*a*, 128*b*, 128*c*, 128*d*, 128*e*, 128*f* may be an indication of interactions between different sections within the wellbore 110. An increasing acoustic activity, or an electromagnetic field may be an indication that marker particles configured to increase such signals are moving toward the regions in which the increased signals are detected. A decreasing acoustic activity or electromagnetic field may be an indication that marker particles configured to decrease such signals are moving away from the regions in which the decreasing signals are detected. By way of non-limiting example, an increase or decrease in the acoustic activity measured by a receiver may be an indication that acoustically active marker particles have respectively moved toward or away from the zone in which the receiver is located. By way of another example, a decrease in the electromagnetic field measured by a receiver in a zone where electromagnetically active marker particles have been placed within fractures 116 may be an indication that the electromagnetically active marker particles within the fracture 116 are mechanically failing or moving out of the fractures 116 and exiting the wellbore 110 with the produced fluid.

In some embodiments, fractures 116 in a first zone (e.g., the hydrocarbon-containing zone 103) may be filled with first marker particles. The first marker particles may adhere to the subterranean formation within the fractures 116. Fractures 116 in a second zone (e.g., the second horizontal zone 106) may be filled with second marker particles. The second marker particles may adhere to the subterranean formation within the fractures 116 in the second zone. The first zone and the second zone may each include hydrocarbons. In some embodiments, the first marker particles and the second marker particles are the same. In other embodiments, the first marker particles and the second marker particles are different. For example, the first marker particles may be substantially electrically conductive and the second marker particles may be substantially electrically non-conductive (i.e., resistive). The first marker particles may be substantially magnetic and the second materials may be substantially non-magnetic. Alternatively, the first marker particles may be substantially acoustically active and the second marker particles may be substantially acoustically non-active. In other embodiments, the first marker particles are substantially electrically conductive or magnetic and the second marker particles are another of substantially electrically conductive or magnetic.

Different horizontal zones of the subterranean formation may include hydrocarbon-containing reservoirs. In some embodiments, the subterranean formation may be fractured in at least a first horizontal zone and a second horizontal zone. The first horizontal zone may be fractured with a fracturing fluid including first marker particles and the second horizontal zone may be fractured with a fracturing fluid including second marker particles. The first marker particles and the second marker particles may be the same or may be different. Movement of the fluids from either of the first horizontal zone 105 or the second horizontal zone 106 may be monitored by detecting changes in signals received by the plurality of receivers 128*a*, 128*b*, 128*c*, 128*d*, 128*e*, 128*f* as the marker particles interact with signals transmitted by the plurality of transmitters 126*a*, 126*b*, 126*c*, 126*d*, 126*e*, 126*f*.

It may be desirable to monitor the aquifer zone 102 during production. Fluids from the hydrocarbon-containing zone 103 may undesirably mix with the aquifer zone 102. In some embodiments, marker particles may be placed within the hydrocarbon-containing zone 103. The marker particles may be substantially acoustically active, electrically conductive, magnetic, or electromagnetically active. A change in an electric conductivity, a magnetism, an acoustic activity, or an electromagnetic field measured by a receiver in the aquifer zone 102 or in the produced fluid at the surface may correspond to movement of materials from the hydrocarbon-containing zone 103 to the aquifer zone 102.

In some embodiments, first marker particles may be injected into and adhere to the frac pack assembly 118 and second marker particles may be injected into fractures 116 of the subterranean formation surrounding the frac pack assembly 118. The first marker particles may include hollow marker particles 200*a* (FIG. 2A) and the second marker particles may include solid marker particles 200*b* (FIG. 2B). Both of the hollow marker particles 200*a* and the solid marker particles 200*b* may be mixed with a fracturing fluid and injected into fractures 116 and into the frac pack assembly 118 at the same time. The hollow marker particles 200*a* may be configured to mechanically fail under closure stresses exerted by the formation after the fracturing pressure is withdrawn. Measuring an acoustic activity characteristic of the hollow marker particles 200*a* outside of the zone in which the frac pack assembly 118 is located may be an indication of mechanical failure of the frac pack assembly 118. Measuring an acoustic activity of the solid marker particles 200*b* may be an indication of movement of the solid marker particles 200*b* and closure of the fractures 116. An increasing concentration of marker particles in the frac pack assembly 118 may be an indication of flow restrictions within the frac pack assembly 118. The increasing concentration of marker particles in the frac pack assembly 118 may be determined by measuring a field characteristic of the marker particles with receivers adjacent or within the frac pack assembly 118. Corrective action may be taken responsive to the increasing concentration of marker particles in the frac pack assembly. By way of example, a paraffin reducer may be pumped to the frac pack assembly 118 to break the paraffins (e.g., asphaltenes) that block flow channels within the frac pack assembly 118.

One or more corrective actions may be taken responsive to movement of marker particles within the wellbore system 100. By way of example only, corrective actions may include opening or closing sliding sleeves to increase or decrease production rates, remedial work such as cleaning or reaming operations, shutting down a particular zone, refracturing a particular zone, etc. As marker particle concentrations move and fractures 116 close, additional marker particles (e.g., proppants) may be injected into the wellbore 110 to prop open the fractures 116 with additional proppant. Thus, the subterranean formation may be stimulated responsive to movement of the marker particles within the subterranean formation.

While the disclosure is susceptible to various modifications and alternative forms, specific embodiments have been shown by way of example in the drawings and have been described in detail herein. However, the disclosure is not limited to the particular forms disclosed. Rather, the disclosure is to cover all modifications, equivalents, and alternatives falling within the scope of the disclosure as defined by the following appended claims and their legal equivalents.

What is claimed is:

1. A method of detecting a location of fluids within a wellbore, the method comprising:

providing a plurality of signal transmitters and a plurality of signal receivers in a wellbore in a subterranean formation;

injecting first marker particles having a first characteristic acoustic activity into a first zone of the subterranean formation and attaching the first marker particles to organic surfaces within the first zone, wherein attaching the first marker particles to organic surfaces comprises adhering molecules or functional groups of the first marker particles configured to adhere to at least one of asphaltenes, alkanes, clays, and biological incrustation within the first zone;

injecting second marker particles having a second characteristic acoustic activity different than the first characteristic acoustic activity into a second zone of the subterranean formation and attaching the second marker particles to organic surfaces within the second zone, wherein attaching the second marker particles to organic surfaces comprises adhering molecules or functional groups of the second marker particles configured to adhere to at least one of asphaltenes, alkanes, clays, and biological incrustation within the second zone;

generating an acoustic signal with at least one of the plurality of signal transmitters and transmitting the signal through the first marker particles and the second marker particles; and detecting a reflected acoustic signal from the first marker particles and detecting a reflected acoustic signal from the second marker particles with at least one signal receiver of the plurality of signal receivers and detecting a location of at least one of the first marker particles and the second marker particles.

2. The method of claim 1, further comprising stimulating the subterranean formation responsive to movement of at least one of the first marker particles and the second marker particles.

3. The method of claim 1, further comprising detecting at least one of an acoustic activity and an electromagnetic field within the subterranean formation prior to injecting the first marker particles and injecting the second marker particles into the subterranean formation.

4. The method of claim 1, wherein providing a plurality of signal transmitters and a plurality of signal receivers in a wellbore comprises providing a production string comprising a plurality of signal transmitters and a plurality of signal receivers attached to a fiber optic cable.

5. The method of claim 1, wherein providing a plurality of signal transmitters and a plurality of signal receivers in a wellbore comprises providing a first plurality of signal transmitters and a first plurality of signal receivers within the first zone and providing a second plurality of signal transmitters and a second plurality of signal receivers within the second zone.

6. The method of claim 1, wherein:

injecting first marker particles having a first characteristic acoustic activity into a first zone of the subterranean formation comprises injecting first marker particles having a first shape into the first zone; and injecting second marker particles having a second characteristic acoustic activity different than the first characteristic acoustic activity into a second zone of the subterranean formation comprises injecting second marker particles having a second shape into the second zone.

7. The method of claim 1, wherein:

injecting first marker particles having a first characteristic acoustic activity into a first zone of the subterranean formation comprises injecting first marker particles into fractures of the subterranean formation; and injecting second marker particles having a second characteristic acoustic activity different than the first characteristic acoustic activity into a second zone of the subterranean formation comprises injecting second marker particles into a frac pack assembly.

8. The method of claim 1, wherein:

injecting first marker particles having a first characteristic acoustic activity into a first zone of the subterranean formation comprises injecting first marker particles comprising nanoparticles into the first zone; and injecting second marker particles having a second characteristic acoustic activity different than the first characteristic acoustic activity into a second zone of the subterranean formation comprises injecting second marker particles comprising proppants into the second zone.

9. The method of claim 1, wherein detecting a reflected acoustic signal from the first marker particles and detecting a reflected acoustic signal from the second marker particles with at least one signal receiver of the plurality of signal receivers and detecting a location of at least one of the first marker particles and the second marker particles comprises logging the at least one of the detected reflected acoustic signal from the first marker particles and from the second marker particles.

10. The method of claim 1, further comprising detecting at least one of an electrical conductance and a magnetism of at least one of the first marker particles and the second marker particles in a produced fluid to determine a source of the produced fluid.

11. A method of detecting a flow of hydrocarbons through fractures in a subterranean formation, the method comprising:

mixing, with a fracturing fluid, first marker particles surrounded by a first encapsulant configured to release the first marker particles at a first temperature, pressure, or salinity of a first zone of a subterranean formation;

fracturing the first zone of the subterranean formation with the fracturing fluid and adhering the first marker particles to the subterranean formation within the fractures of the first zone;

mixing, with another fracturing fluid, second marker particles surrounded by a second encapsulant configured to release the second marker particles at a second, different temperature, pressure, or salinity of a second zone of the subterranean formation;

fracturing the second zone of the subterranean formation with the another fracturing fluid and adhering the second marker particles to the subterranean formation within the fractures of the second zone; and detecting at least one of an electrical conductivity of a produced fluid, a magnetism of the produced fluid, an acoustic activity within at least one of the first zone and second zone, and an electromagnetic field within at least one of the first zone and the second zone.

12. The method of claim 11, wherein mixing, with a fracturing fluid, first marker particles comprises mixing first marker particles comprising hollow marker particles with the fracturing fluid.

13. The method of claim 11, wherein mixing, with another fracturing fluid, second marker particles comprises mixing second marker particles comprising solid marker particles with the another fracturing fluid.

14. The method of claim 11, wherein:

mixing, with a fracturing fluid, first marker particles comprises mixing first marker particles configured to be acoustically active with the fracturing fluid; and mixing, with another fracturing fluid, second marker particles comprises mixing second marker particles configured to be at least one of electromagnetically active, exhibit a characteristic electrical conductivity, and exhibit a characteristic magnetism with the another fracturing fluid.

15. The method of claim 11, wherein:

mixing, with a fracturing fluid, first marker particles comprises mixing electrically conductive marker particles with the fracturing fluid; and mixing, with another fracturing fluid, second marker particles comprises mixing electrically resistive marker particles with the another fracturing fluid.

16. The method of claim 11, wherein:

fracturing the first zone of the subterranean formation comprises fracturing the subterranean formation in a first horizontal zone of the subterranean formation; and fracturing of the second zone of the subterranean formation comprises fracturing the subterranean formation in a second horizontal zone of the subterranean formation.

17. A downhole system, comprising:

a wellbore intersecting a plurality of zones within a subterranean formation;

a plurality of signal transmitters and a plurality of signal receivers extending along the wellbore adjacent the plurality of zones;

first marker particles within the subterranean formation, the first marker particles exhibiting a first characteristic acoustic activity and comprising molecules or functional groups configured to adhere to at least one of asphaltenes, alkanes, clays, and biological incrustation; and second marker particles within the subterranean formation, the second marker particles exhibiting a second characteristic acoustic activity different than the first characteristic acoustic activity, and comprising molecules or functional groups configured to adhere to at least one of asphaltenes, alkanes, clays, and biological incrustation.

18. The method of claim 1, further comprising injecting third marker particles having a third characteristic acoustic activity different than the first characteristic acoustic activity and the second characteristic acoustic activity into a third zone of the subterranean formation.

19. The method of claim 1, further comprising selecting the first marker particles to comprise functional groups configured to adhere to at least one of asphaltenes, alkanes, clays, and biological incrustation.

20. The method of claim 1, wherein:

injecting first marker particles having a first characteristic acoustic activity comprises injecting first marker particles comprising a coating exhibiting the first characteristic acoustic activity; and injecting second marker particles having a second characteristic acoustic activity comprises injecting second marker particles comprising a coating exhibiting the second characteristic acoustic activity.

* * * * *